US008944156B2

(12) United States Patent
Keat et al.

(10) Patent No.: US 8,944,156 B2
(45) Date of Patent: Feb. 3, 2015

(54) HANGER FLOATING RING AND SEAL ASSEMBLY SYSTEM AND METHOD

(75) Inventors: Lim Haw Keat, Singapore (SG); Joseph Chan, Singapore (SG)

(73) Assignee: Cameron International Corporation, Houston, TX (US)

( * ) Notice: Subject to any disclaimer, the term of this patent is extended or adjusted under 35 U.S.C. 154(b) by 489 days.

(21) Appl. No.: 13/125,569

(22) PCT Filed: Apr. 19, 2010

(86) PCT No.: PCT/IB2010/051711

§ 371 (c)(1),
(2), (4) Date: Sep. 6, 2011

(87) PCT Pub. No.: WO2010/122485

PCT Pub. Date: Oct. 28, 2010

(65) Prior Publication Data

US 2012/0024542 A1 Feb. 2, 2012

(30) Foreign Application Priority Data

Apr. 22, 2009 (SG) ..... 200902747-5

(51) Int. Cl.
*E21B 33/04* (2006.01)
*E21B 23/00* (2006.01)

(52) U.S. Cl.
CPC ..... *E21B 33/04* (2013.01)
USPC ..... 166/75.14; 166/96.1; 166/85.3; 166/382

(58) Field of Classification Search
CPC ..... E21B 23/00; E21B 33/03; E21B 33/04
USPC ..... 166/75.14, 96.1, 382, 85.3
See application file for complete search history.

(56) References Cited

U.S. PATENT DOCUMENTS

| | | | | | |
|---|---|---|---|---|---|
| 3,068,027 | A | * | 12/1962 | Lewis et al. | 285/123.8 |
| 3,273,646 | A | * | 9/1966 | Walker | 285/123.12 |
| 3,457,992 | A | * | 7/1969 | Brown | 166/335 |
| 3,460,615 | A | * | 8/1969 | Watkins | 166/208 |
| 3,468,558 | A | * | 9/1969 | Ahlstone | 285/18 |
| 3,871,449 | A | * | 3/1975 | Ahlstone | 166/183 |
| 3,924,678 | A | * | 12/1975 | Ahlstone | 166/120 |
| 4,333,528 | A | * | 6/1982 | Woodman | 166/117.5 |
| 4,402,535 | A | * | 9/1983 | Bridges | 285/123.11 |
| 4,416,472 | A | * | 11/1983 | Fowler et al. | 285/3 |

(Continued)

OTHER PUBLICATIONS

PCT Search Report and Written Opinion of PCT Application No. PCT/IB20101051711 mailed Feb. 16, 2011.

*Primary Examiner* — Kenneth L Thompson
(74) *Attorney, Agent, or Firm* — Fletcher Yoder P.C.

(57) ABSTRACT

Systems and methods are provided for isolating a landing ring of a hanger from pressure inside a wellhead and sealing a portion of the hanger via a seal assembly. The hanger includes a floating ring axially interposed between the landing ring and the seal assembly, and between the landing ring and a shoulder of the hanger. The seal assembly includes one or more radially retractable elastomeric seals that are radially retracted during run in of the seal assembly. The radially retractable seals may be radially expanded via shearing of one or more shear pins by torque applied to the seal assembly. The seal assembly may also include one or more metal seals having a plurality of rings having a nib configuration that includes three smaller nibs for sealing and a larger flat nib for withstanding the energizing load on the seal assembly.

30 Claims, 13 Drawing Sheets

(56) References Cited

U.S. PATENT DOCUMENTS

| | | | | | |
|---|---|---|---|---|---|
| 4,653,589 | A | | 3/1987 | Alandy | |
| 4,781,387 | A | * | 11/1988 | Braugh | 277/329 |
| 4,794,988 | A | | 1/1989 | Van Bilderbeek | |
| 5,025,864 | A | * | 6/1991 | Nobileau | 166/348 |
| 5,080,173 | A | * | 1/1992 | Brammer | 166/348 |
| 5,226,484 | A | * | 7/1993 | Stephen | 166/382 |
| 5,464,063 | A | * | 11/1995 | Boehm, Jr. | 166/382 |
| 7,040,412 | B2 | | 5/2006 | Deberry | |
| 8,347,966 | B2 | * | 1/2013 | Nguyen et al. | 166/345 |
| 2005/0284640 | A1 | * | 12/2005 | Borak, Jr. | 166/369 |

* cited by examiner

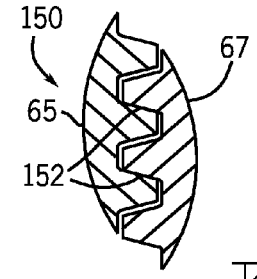
FIG. 10E
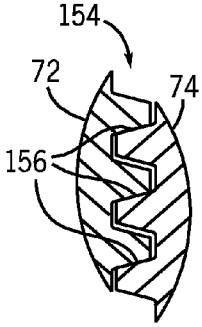
FIG. 10F
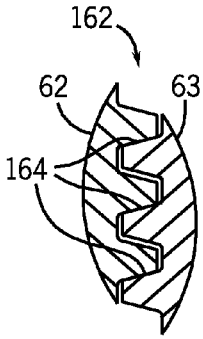
FIG. 10G
FIG. 10D
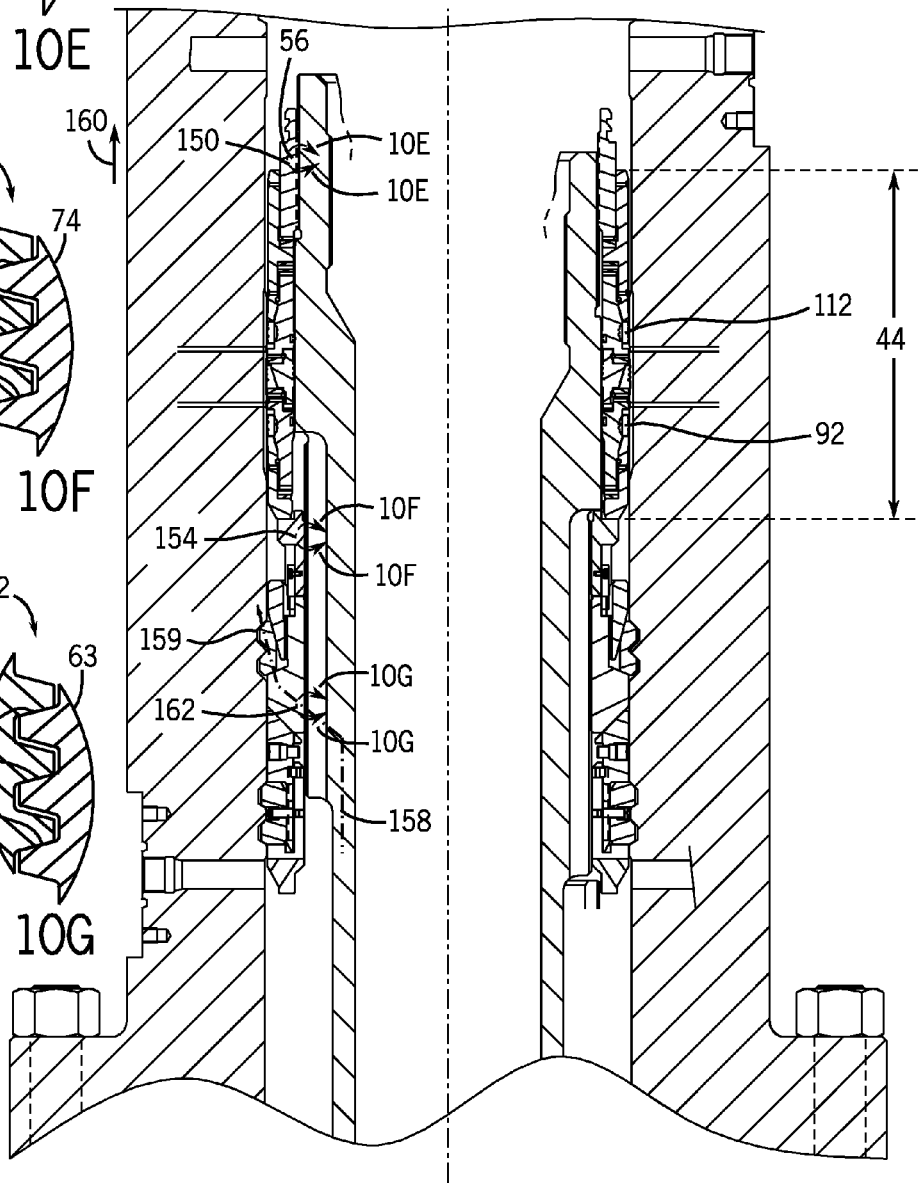

150
67
65
152

168
154
72
74
156

162
63
62
170

150
10I
10I
166
10J
154
10J
10K
162
10K
169
112
92

HANGER FLOATING RING AND SEAL ASSEMBLY SYSTEM AND METHOD

CROSS-REFERENCE TO RELATED APPLICATIONS

This application claims priority to and benefit of PCT Patent Application No. PCT/IB2010/051711, entitled "Hanger Floating Ring and Seal Assembly System and Method," filed Apr. 19, 2010, which is herein incorporated by reference in its entirety, and which claims priority to and benefit of Singapore Patent Application No. 200902747-5, entitled "Hanger Floating Ring and Seal Assembly System and Method", filed on Apr. 22, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

In some drilling and production systems, hangers, such as a tubing hanger, may be used to suspend strings (e.g., piping for various flows in and out of the well) of the well. Such hangers are disposed in a spool (also referred to as a bowl). In addition to suspending strings inside the wellhead assembly, the hangers provide sealing capabilities to seal the interior of the wellhead assembly and strings from pressure inside the wellhead assembly. In some systems, pressure from above or below the hanger may cause movement of the hanger in the wellhead. The hanger movement may put pressure on other components, such as landing shoulders or seals. Additionally, any adjustability of the hanger may compromise the ability of the hanger to provide sealing during operation of the wellhead assembly.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIGS. 5A-C depicts a cross-section of the mineral extraction system illustrating installation of a hanger, adjustable landing ring, and floating ring in accordance with an embodiment of the present invention;

FIGS. 10A-10K depict a cross-section of the mineral extraction system illustrating reaction of a seal assembly of the mineral extraction system in accordance with an embodiment of the present invention.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present invention include various components to isolate a landing ring of a hanger and to ensure seal integrity of a seal assembly installed concentrically around a hanger. For example, embodiments may include a floating ring disposed between the landing ring and the shoulder of hanger, such that any movement of the hanger is transferred to the floating ring and isolated from the landing ring. Embodiments may also include a seal assembly that includes radially retractable seals so that the seals may be retracted during installation of the seal assembly, preventing damage to the radially retracted seals during installation. The radially retracted seals may be radially expanded to seal the seal assembly against the wellhead. Additionally, the seal assembly may include metal seals having a configuration to distribute sealing and energizing loads. The metal seals may include multiple rings having a smaller surface (e.g., nib) to provide sealing of the metal seal and a larger ring disposed between, above, or below the multiple rings and having a large flat surface (e.g., nib) for withstanding the energizing load.

Figure 1:
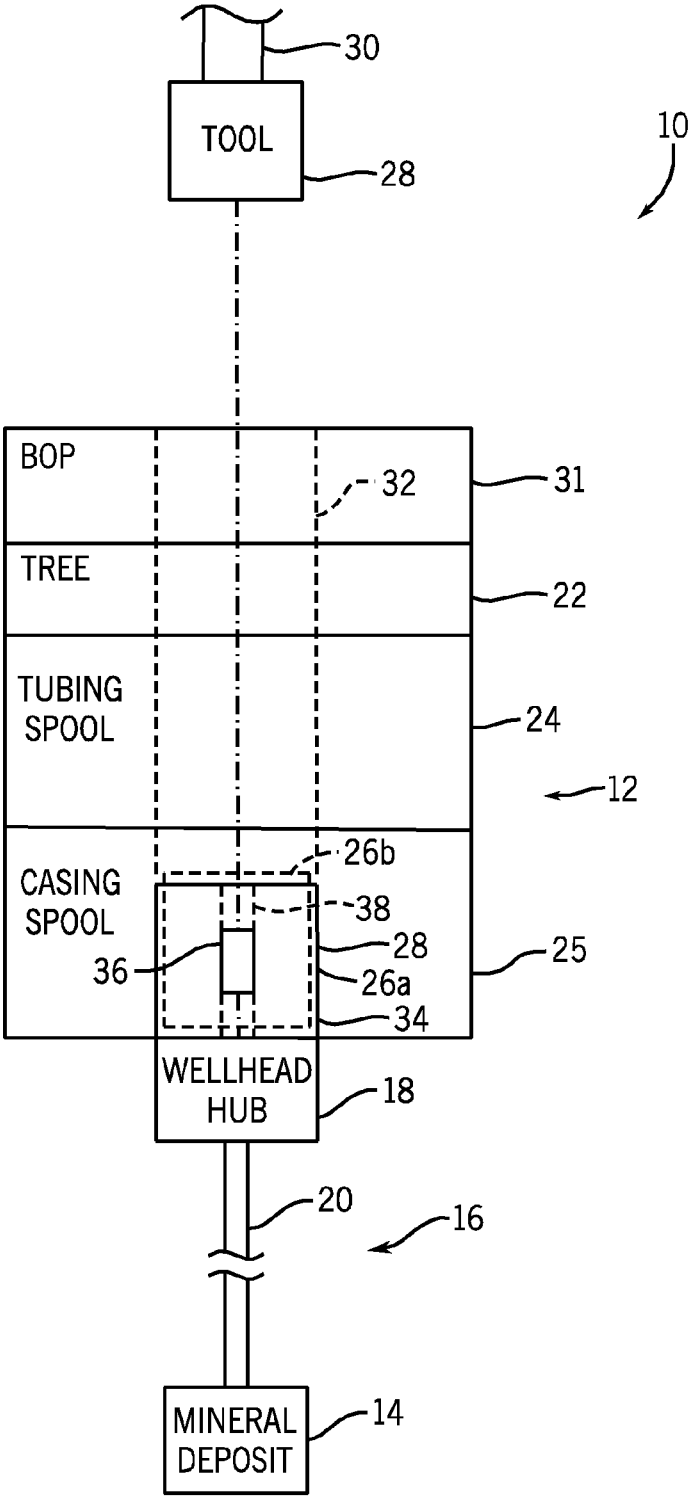
FIG. 1 is a block diagram that illustrates a mineral extraction system in accordance with an embodiment of the present invention.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes what is colloquially referred to as a Christmas tree 22 (hereinafter, a tree), a tubing spool 24, a casing spool 25, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34, and the casing spool 25 includes a casing spool bore 36. The bores 34 and 36 connect (e.g., enables fluid communication between) the tree bore 32 and the well 16. Thus, the bores 34 and 36 may provide access to the well bore 20 for various completion and worker procedures. For example, components can be run down to the wellhead 12 and disposed in the tubing spool bore 34 and/or the casing spool bore 36 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as mandrels, seals, plugs and valves, to control and regulate the well 16. For example, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20.

The hanger 26 may be an adjustable hanger such that the hanger is adjustable between a first position 26*a* and a second position 26*b*. In some embodiment, the adjustable hanger may be used when a particular string is configured to land off at two positions (e.g. one position at a mudline (sea floor), such as a mudline hanger/wellhead configuration, and one position at a tieback I at another location within the wellhead). Adjustment of the hanger 26 may be used when attempting to find a land off position, such as a secondary land off point at a tieback. As discussed below, the adjustable hanger 26 may include various seals, rings, and other components to ensure sealing during landing and adjusting of the hanger 26. Pressures from the wellhead 12 or through the bores 32, 34, and 36 may cause movement of the hanger 26 relative to the casing spool 25 or the tubing spool 24. This movement may be further compounded by an adjustable landing ring used with the hanger 26. The hanger movement can stress and/or deform the seals, rings, and other components of the hanger and possible cause leaks. As explained below in FIGS. 2-11, embodiments of the present invention include components to reduce, eliminate, and/or redirect stress and/deformation of these seal, rings, and other components of the hanger 26.

Figure 2:
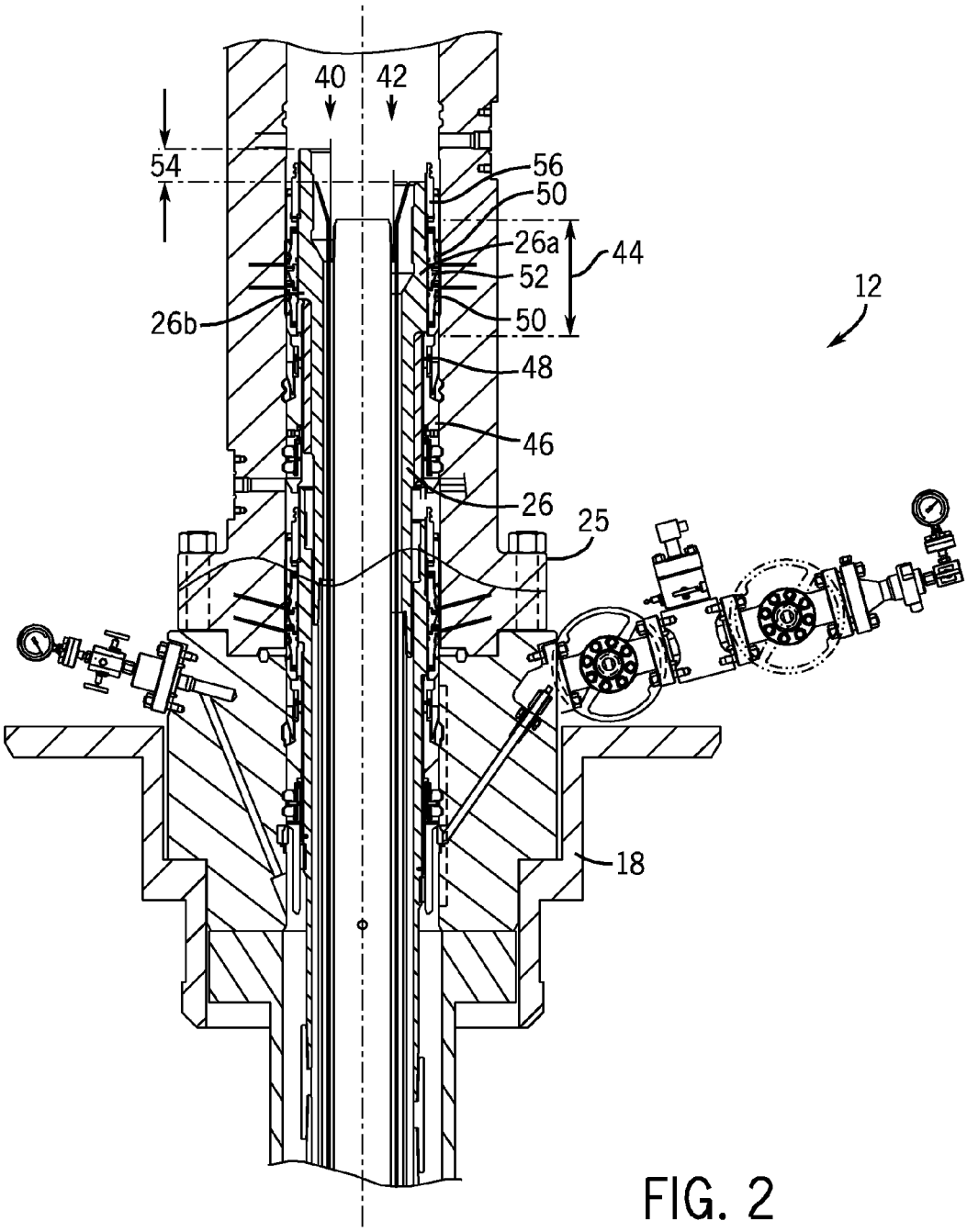
FIG. 2 is a cross-section of a section of the mineral extraction system of FIG. 1 in accordance with an embodiment of the present invention.

FIG. 2 depicts a cross-section of the casing spool 25, the hanger 26, and the wellhead hub 18 in accordance with an embodiment of the present invention. The left side 40 of FIG. 2 illustrates the adjustable hanger 26 in the second position 26*b*, and the right side 42 of FIG. 2 depicts the adjustable hanger 26 in the first position 26*a*. The adjustable hanger 26 includes an annular seal assembly 44 that provides the sealing for the adjustable hanger 26 against the wellhead 12 (e.g., against the casing spool 25). FIG. 2 depicts landing mechanisms 46 that provide for landing of one or more hangers 26 into the casing spool 25 or tubing spool 24. Additionally, a landing shoulder mechanism 64 is shown that provides for a predetermined datum for the landing of the one or more hangers 26 into the casing spool 25 or tubing spool 24.

Embodiments of the present invention include a first feature 48, a second feature 50 and a third feature 52. In combination, these features 48, 50, and 52 enable installation (e.g., run-in, landing, and/or adjusting) of the hanger 26 without comprising or damaging the seal assembly 44 and/or the landing mechanism 46. For example, as shown in FIG. 2, the hanger 26 may be moved between the second position 26*b* and the first position 26*a*, e.g., through the axial distance 54, without movement of the seal assembly 44 or the landing mechanism 46. In some embodiments, the hanger 26 may be adjusted axially from about 0 inches to about 4 inches from the initial landing position (e.g., shown in the right side 42 of FIG. 2). The upper portion of the seal assembly 44 may include a carrier nut 56 to provide for energizing the seals of the seal assembly 44. Each feature 48, 50, and 52 will be illustrated in close-up views and described in detail below with reference to FIGS. 3-9.

Figure 3:
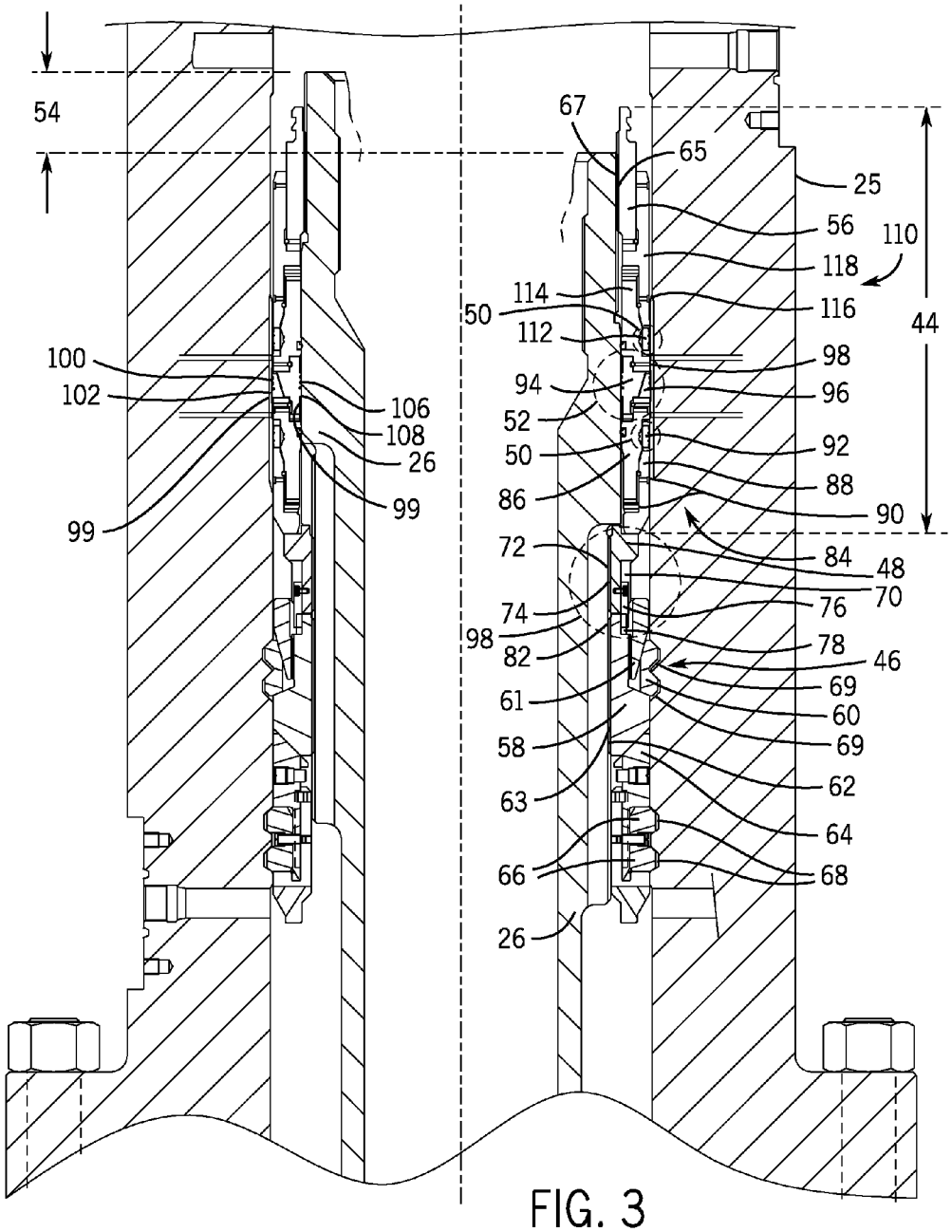
FIG. 3 is a close-up of the cross-section of FIG. 2 in accordance with an embodiment of the present invention.

FIG. 3 is a close-up view of the hanger 26 and features 48, 50, and 52 of FIG. 2 in accordance with an embodiment of the present invention. FIG. 3 illustrates an adjustable landing ring 58, a hanger lockdown ring 60, and a lockdown ring actuation ring 61. The adjustable landing ring 58 includes threads 62 to couple to the hanger 26 via hanger outer threads 63. The carrier nut 56 of the seal assembly 44 may include threads 65 to couple to the hanger 26 via hanger outer threads 67.

The landing mechanism 46 aids in landing the hanger 26 onto a landing shoulder 64 that may be locked into place via lockdown rings 66 that engage grooves 68 of the wellhead 12. The landing shoulder 64 may be previously run into the wellhead 12 with a running tool (not shown), landed into position via a datum point (e.g., a pin inserted into a recess of the side of the wellhead 12) and locked down to the wellhead 12 to provide an indication of landing of the hanger 26 (e.g., a landoff datum) to the adjustable landing ring 58 when the hanger 26 is lowered into the wellhead 12. Once the landing mechanism 46 is engaged with the landing shoulder 64, the landing mechanism 46 (and the hanger 26) may be locked by actuation of the lockdown ring actuation ring 61 such that the lockdown ring 60 is locked into grooves 69 of the wellhead 12. Specifically, axial movement of ring 61 engages ring 60 along tapered surfaces, such that ring 60 moves radially into grooves 69. In an embodiment, the hanger 26 may be run into the wellhead 12 with a hanger running tool (not shown) after the landing shoulder 64 is installed to create a landoff datum for the hanger 26. The hanger string may be a "tieback" to a mudline hanger to provide an anchor point, and then the hanger 26 may be tensioned to a predetermined value to stretch the hanger string. While under tension, the adjustable landing ring 58 is rotated via the hanger running tool to land onto the landing shoulder 64. Additional torque may be applied to the hanger running tool to shear one or more landing shear pins (not shown) located between the actuation ring 61 and the hanger 26 to move the actuation ring 62 axially toward the adjustable landing ring 58. The actuation ring 61 pushes the lockdown ring 60 into the grooves 69, thus locking the hanger string to the wellhead 12. After this process, tension may be released from the rig and the landing shoulder 64 transfers the load to the wellhead via the grooves 64.

The first feature 48 includes an annular floating ring 70 vertically (e.g., axially) interposed between the hanger 26 and the seal assembly 44. The floating ring 70 may be coupled to the hanger 26 via threads 72 and hanger outer threads 74. The floating ring 70 and adjustable landing ring 58 may both couple to the hanger 26 via the same outer diameter threads. For example, threads 63 and 74 (and threads 67 for coupling the carrier nut 56) may be sections of contiguous outer diameter threads of the hanger 26. The floating ring 70 may be unsecured to the wellhead 12, thus allowing the floating ring 70 to "float" along the wellhead 12. That is, because the floating ring 70 is coupled to the hanger 26 via threads 72 and 74, the floating ring 70 may move with movement of the hanger 26 without being secured to the wellhead 12.

The floating ring 70 is engaged to the adjustable landing ring 58 via one or more axial protrusions 76 (e.g., a tongue) that engage one or more axial slots 78 of the adjustable landing ring 58 such that the floating ring 70 rotates in sync with the adjustable landing ring 58 but does not allow axial load transfer between the floating ring 70 and the adjustable landing ring 58. The one or more protrusions 76 may be disposed at any number of positions around the circumference of the floating ring 70. Similarly, the one or more slots 78 may be correspondingly disposed around the circumference of the adjustable landing ring 58. In other embodiments, the floating ring 70 may be coupled to the adjustable landing ring 58 via a key and keyway, a castellation feature, or any other suitable mechanism.

The engagement between the floating ring 70 and the landing ring 58 and their relative position along the outer threads 63 and 74 of the hanger 26 maintains an axial gap 82 between the adjustable landing ring 58 and the floating ring 70. As a result of the gap 82 between the floating ring 70 and the adjustable landing ring 58, the floating ring 70 isolates any vertical (e.g., axial) movement of the hanger 26 (as a result of pressure either below or above the hanger) from the adjustable landing ring 58. The floating ring 70 moves (e.g., "rides along") with any axial movement of the hanger 26 without transferring or offloading any axial load onto the landing shoulder 64 (which may unload and/or overload the seal assembly 44 causing leakage).

Turning now to the seal assembly 44, the lower end 84 of the seal assembly 44 includes an annular lower seal body 86, a lower seal actuation ring 88, and a lower actuation ring shear pin 90 (shown in the sheared position). The lower seal body 88 may abut the floating ring 70 when the hanger 26 is installed, landed, and sealed in the wellhead 12. The second feature 50 includes a radially retractable lower elastomeric seal 92 (e.g., an annular seal). The retractable lower elastomeric seal 92 is generally retracted in an inward radial direction when the hanger 26 is run into the wellhead 12, and, as described further below, is expanded in an outward radial direction to "pack off" a section of the hanger 26 via axial movement of the lower seal body 86 and lower seal actuation ring 88 after collapse of the lower ring actuation shear pin 90. Thus, the lower elastomeric seal 92 may be referred as having a "run-into-hole pack-off" application, such that the lower elastomeric seal 92 is retracted during "running" of the seal assembly 44 into the "hole." In some embodiments, the retractable elastomeric seal 92 may be a metal end cap (MEC) elastomeric seal.

Turning now to the third feature 52, the third feature 52 includes an annular inner metal seal 94 and an annular outer metal seal 96. The seals 94 and 96 may be energized via the collapse of a middle shear pin 98. In some embodiments, the inner metal seal 94 may be a Canh seal, such as an N-Canh, MRD-Canh seal, or any suitable Canh seal. Similarly, the outer metal seal 96 may be a Cahn seal, such as an N-Cahn seal, MRD-Canh seal, or any suitable Canh seal.

As will be appreciated, the metal seals 94 and 96 may include a plurality of rings 99 having contoured surfaces for sealing. The outer surface of each ring may be referred as a "nib." The third feature 52 includes the outer metal seal 96 having a plurality of rings that include three small radius nibs 100 and a large flat nib 102. Similarly, the inner metal seal 94 includes a plurality of rings that include three small radius nibs 106 and a large flat nib 108. In the embodiment depicts in FIG. 3, the three small radius nibs 100 and 106 are located vertically above the large flat nibs 102 and 108 respectively. The large flat nibs 102 and 108 are configured to take the high setting and/or energizing load when installing the seal assembly 44, thereby substantially reducing or preventing the possibility of damage to the seal 94 (and nibs 100) and seal 96 (and nibs 106). Once energized, the small radius nibs 100 and 106 provide sealing of the metal seals 94 and 96.

The upper end 110 of the seal assembly 44 includes the second feature 50, such as a radially retractable upper elastomeric seal 112 (e.g., an annular seal), an annular upper seal body 114, an upper actuation ring shear pin 116, and an upper seal actuation ring 118. In some embodiments, the upper elastomeric seal 112 may be an MEC seal. As discussed above with regard to the second feature 50, the retractable elastomeric seal 112 may be generally retracted in an inward radial direction when the hanger 26 is run axially into the wellhead 12. As described further below, the retractable elastomeric seal 112 may be expanded in an outward radial direction through axial movement of the upper seal body 114 and the upper seal actuation ring 118 after collapse of the upper ring actuation shear pin 116. For example, the ring 118 may engage the upper seal body 114 along tapered surfaces, such that axial movement imparts a radial force to move the retractable elastomeric seal 112 in the outward radial direction.

Figure 4:
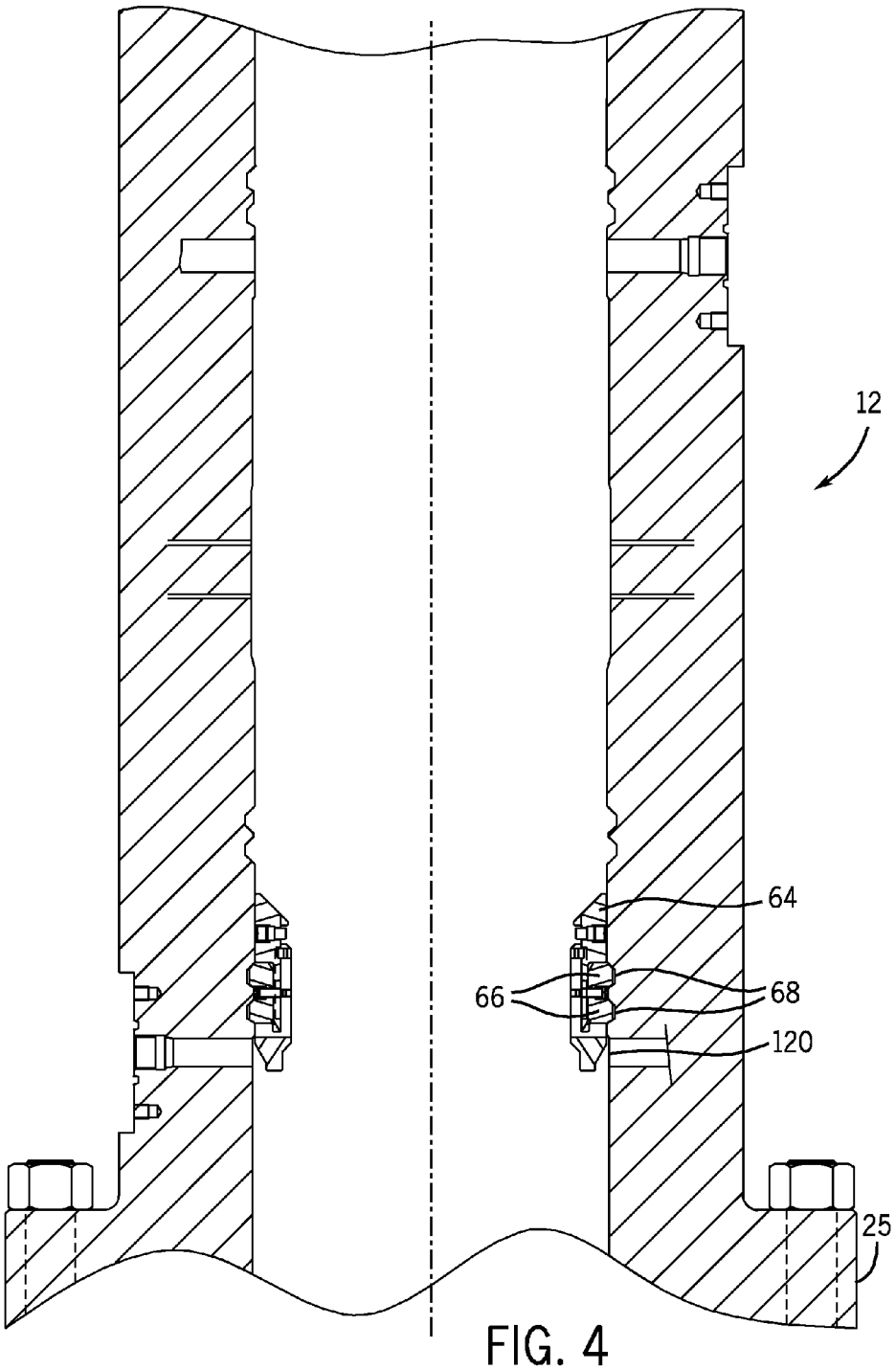
FIG. 4 depicts a cross-section of the mineral extraction system illustrating installation of a landing shoulder in accordance with an embodiment of the present invention.
Figure 5A:
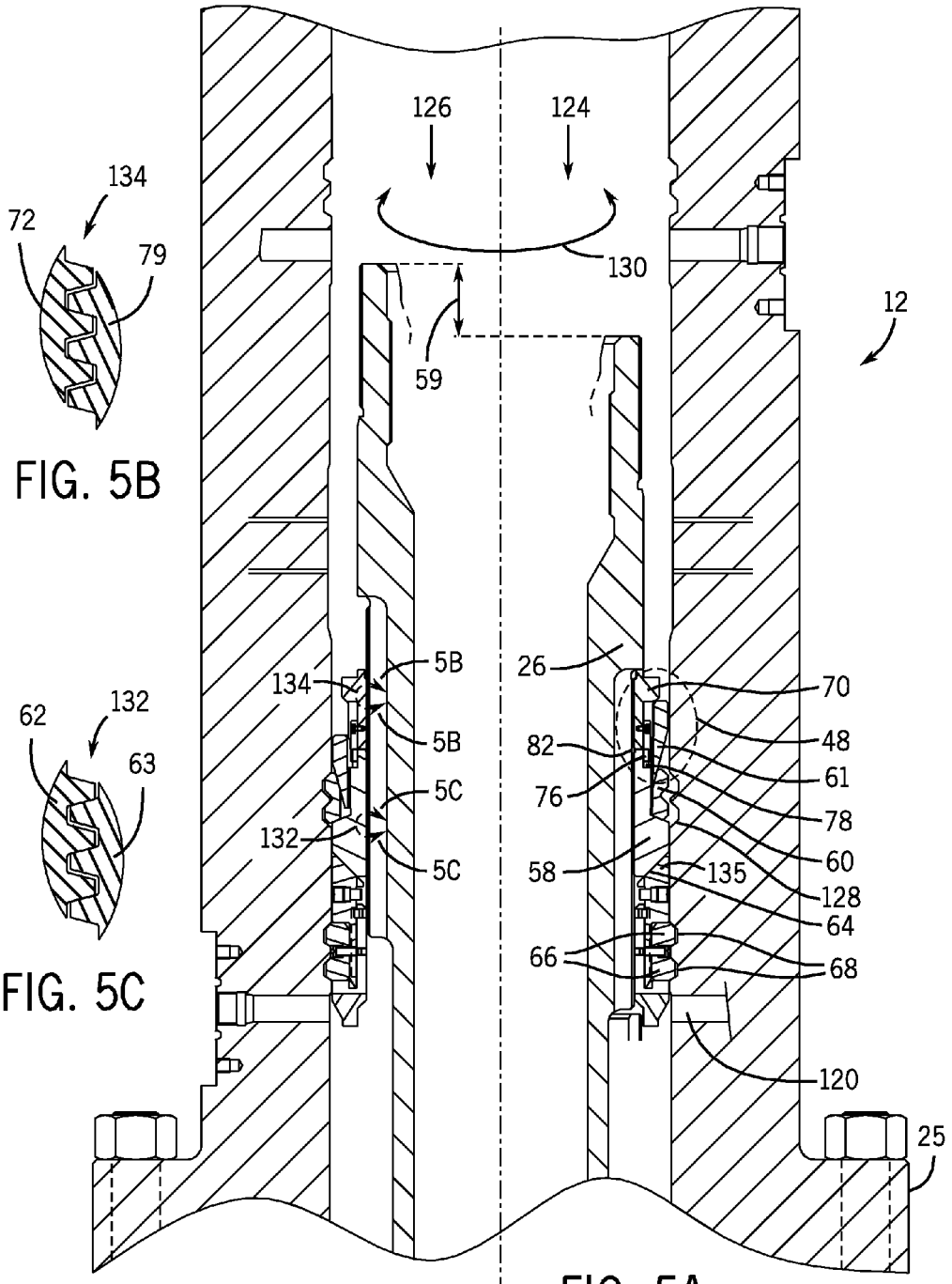

FIGS. 4-9 illustrate installation (e.g., run-in, landing, and sealing) of the hanger 26 and installation (e.g., run-in, loading and energizing) of the seal assembly 44 in accordance with an embodiment of the present invention. FIG. 4 is a cross-section of the wellhead 12 before installation of the hanger 26. FIG. 4 depicts the landing shoulder assembly 64 already run and locked into the wellhead 12, such as with a tool (not shown). The landing shoulder assembly 64 is locked to the wellhead 12 via the lock ring 66 engaged in the recess 68 of the wellhead 12. In some embodiments, a pin (not shown) may be inserted into a receptacle 120 to provide a landoff datum for the landing shoulder assembly 64. For example, the landing shoulder assembly 64 may be run into the wellhead 12 with a tool in an un-collapsed position in which the lock ring 66 is in a retracted position and the upper body of the landing shoulder 64 is extended from and coupled to the lower body via shear pins. When the lower body contacts the pin inserted into the receptacle 120, further downward force may shear the shear pins coupling the upper body to the lower body, allowing the upper body to move down and extend the lock ring 66 radially outward into the groove 68 in the wellhead 12, thus locking the landing shoulder assembly 64 to the wellhead 12. The location of the pin inserted into the receptacle 120 enables alignment of the lock ring 66 with the groove 68, In FIG. 5, the hanger 26 is shown landed in the wellhead 12 onto the landing shoulder assembly 64. As will be appreciated, the hanger 26 may be run and landed via a hanger running tool (not shown). The right side 124 of FIG. 5 illustrates the hanger 26 in the lowest possible position prior to locking of the landing mechanism 48 and, thus, the hanger 26 to the wellhead 12. As shown in the right side 124 of FIG. 5, the hanger 26 with the adjustable landing ring 58 and floating ring 70 lands on the landing shoulder assembly 64. Prior to locking of the hanger 26, the hanger lockdown ring 60 is in a retracted position (e.g., in a radially inward position), and the lockdown ring actuation ring 61 is in a raised axial position. As described above, the floating ring 70 is disposed between the adjustable landing ring 58 and the hanger 26. The floating ring 70 includes the one or more protrusions 76 configured to engage corresponding slots 78 in the adjustable landing ring 58 that synchronizes rotational travel between the floating ring 70 and the adjustable landing ring 58 along the outer threads of the hanger 26.

The left side 126 of the hanger 26 illustrates the hanger 26 landed in the highest position and locked to the wellhead 12. As shown in the left side 126 of the FIG. 5, the lockdown ring actuation ring 61 is in a lowered axial position, such that tapered contact between the lockdown ring actuation ring 61 and the hanger lockdown ring 60 pushes the lockdown ring 60 radially into engagement with the grooves 69 of the wellhead 12. As described above, the first feature 48 that includes the floating ring 70 isolates contact between the hanger 26 and the landing ring 58 and landing shoulder 64. The axial gap 82 between the floating ring 70 and the adjustable landing ring 58 ensures that there is no vertical transfer of force between the floating ring 70 and the adjustable landing ring 58. Any movement of the hanger 26 due to pressure above or below the hanger 26 will not vertically transfer to the adjustable landing ring 58, as the floating ring 70 is interposed between the hanger 26 and the adjustable landing ring 58.

As described above, the protrusions 76 join the floating ring 70 and adjustable landing ring 58 so that vertically (e.g., axially) adjusting the hanger 26 does not change the position of the landing ring 70 and maintains the gap 82. The adjustable landing ring 58 is locked to the wellhead 12 via the lockdown ring 60. The axial distance 58 is the amount of uncertainty of the position of the hanger 26 relative to the wellhead 12, and may dependent on the accuracy of the determination of the distance between the mudline landoff point to the landing point in the wellhead 12 (e.g., essentially the actual length of the hanger string between these two landoff points). The adjustable landing ring 48 is prepared at the rig floor to be moved axially to the top of the hanger thread 134. The left side 126 shows the hanger landed relatively high in the wellhead 12. An actuation tool (not shown), which in some embodiments may be a part of the hanger running tool, may rotate the landing mechanism 46 axially downward to contact the upper body 135 of the landing shoulder assembly 64. The right side 124 of FIG. 5 shows the hanger 26 landed relatively low in the wellhead 12, in which the landing mechanism 46 is already in contact with landing ring upper body 135 without further rotation of the actuation tool and the landing mechanism 46. FIG. 5C indicates a close-up portion of the threads 62 and 63. When the hanger 26 is installed, the weight of the hanger 26 and any tensioning load is transferred to the adjustable landing ring 58 and then to the wellhead 12 via the threads 62 and 63. FIG. 5B indicates a close-up portion of the threads 72 and 74. Because the floating ring 70 is engaged with the landing ring 58 via the protrusions 76 and slots 78, the floating ring 70 rotates together with the landing mechanism 46.

Figure 6:
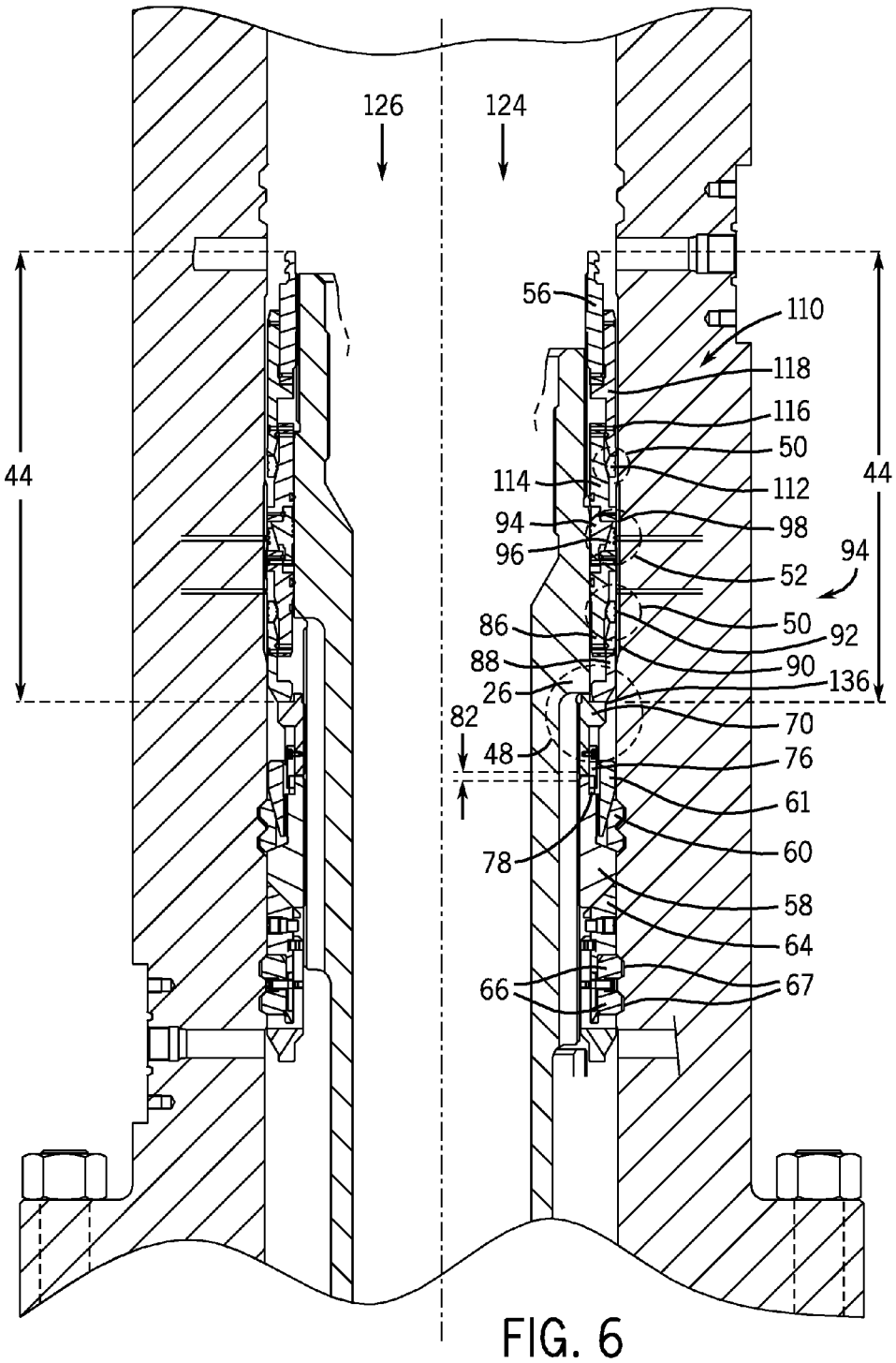
FIG. 6 depicts a cross-section of the mineral extraction system illustration installation of a seal assembly in accordance with an embodiment of the present invention.

FIG. 6 depicts the seal assembly 44 installed around the hanger 26 in accordance with an embodiment of the present invention. As will be appreciated, the seal assembly 44 (and carrier nut 56) may be run in (e.g., axially lowered into) the wellhead 12 with a tool (not shown). The seal assembly 44 may be run into the wellhead 12 until contact is made at a landoff 136 on the floating ring 58. The seal assembly 44 is run into the wellhead 12 in an unenergized state such that no seals are energized during run-in and installation. The shear pins 90, 98, and 116 also remain in an unsheared state during run-in of the seal assembly 44. As mentioned above, the second feature 50 includes the retractable lower elastomeric seal 92 and retractable upper elastomeric seal 112 that are retracted away from the inner wall of the wellhead 12 during run-in of the seal assembly 44 (e.g., seals 92 and 112 retract radially inward), thereby substantially reducing or preventing the possibility of damage to the seals 92 and 112. In the retracted state, the elastomeric seals 92 and 112 cannot be torn, ripped, scraped, or otherwise damaged by the walls of the wellhead 12 as the seal assembly 44 is run-in to the wellhead 12. As shown in the left side 126 and right side 124 of FIG. 6, regardless of the final location of the adjustable hanger 26 (and after making up the string to the mudline hanger), the seal assembly 44 lands in the same location, e.g., at the landoff 136, as it references from the landing shoulder assembly 64 which in turn references the datum from the pin inserted into the receptacle 120 of the wellhead 12.

Figure 7:
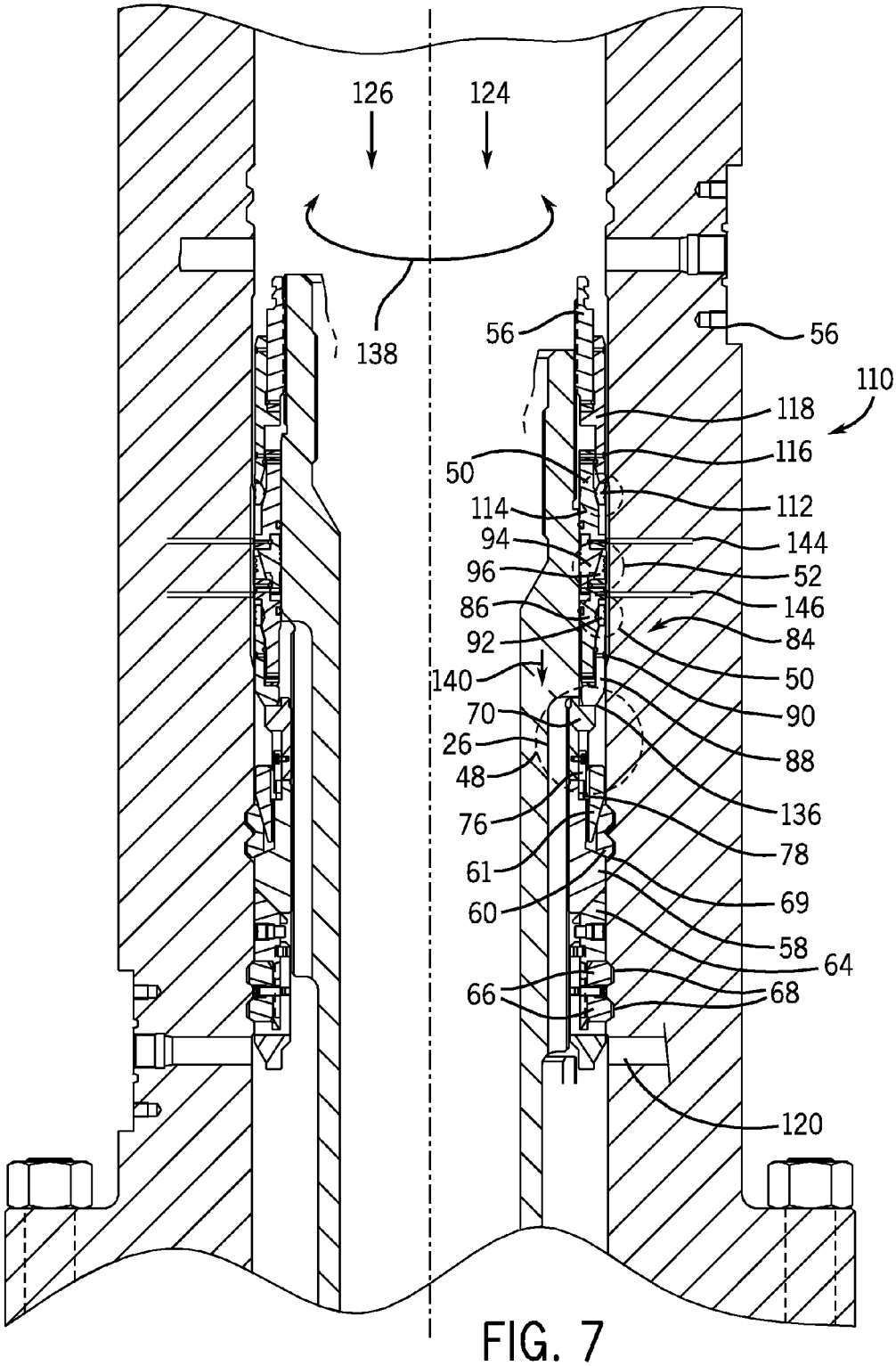
FIG. 7 depicts a cross-section of the mineral extraction system illustrating energizing a lower elastomeric seal in accordance with an embodiment of the present invention.

As shown in FIG. 7, after landing of the seal assembly 44, the lower retractable elastomeric seal 92 may be radially expanded out to seal the lower end 84 of the seal assembly 44. The carrier nut 56 may be rotated, such as in the direction indicated by arrow 138, via a tool (not shown). As the carrier nut 56 is rotated, e.g., tightened, the increased torque on the seal assembly 44 causes the shear pin 90 to fail, e.g., shear, collapsing the shear pin 90 and causing the lower seal body 86 to fall in the axial direction indicated by arrow 140. The lower seal body 86 falls to a second position such that the lower seal body 86 engages the lower retractable seal 92, pushing the retractable lower elastomeric seal 92 from a retracted position to a radially expanded position. In the radially expanded position, the retractable lower elastomeric seal 92 provides sealing of the lower end 84 of the seal assembly 44 against the wellhead 12.

Figure 8:
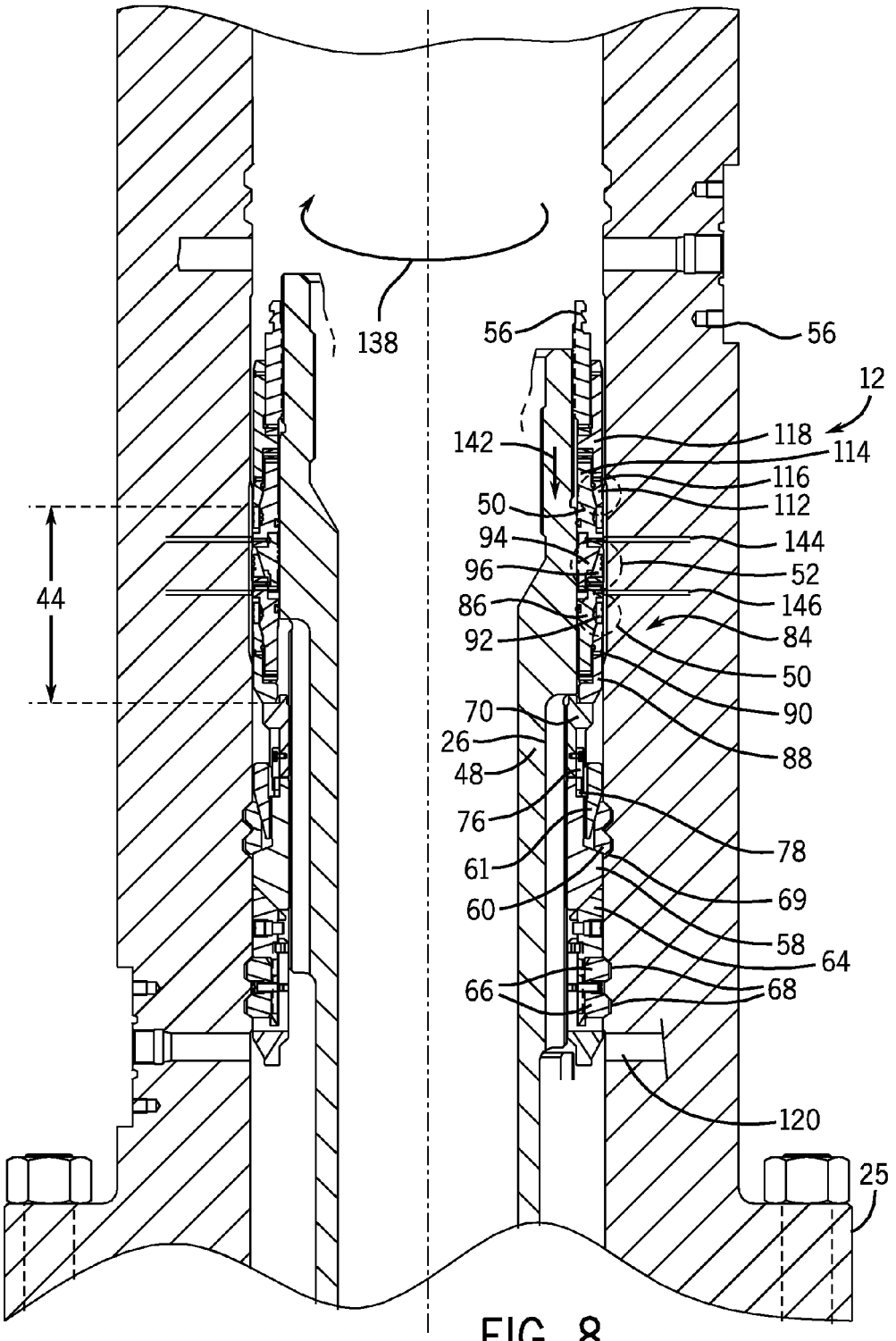
FIG. 8 depicts a cross-section of the mineral extraction system illustrating energizing an upper elastomeric seal of a seal assembly in accordance with an embodiment of the present invention.

FIG. 8 depicts sealing of the upper end 110 of the seal assembly 44 with the retractable upper elastomeric seal 112 in accordance with an embodiment of the present invention. Increased setting torque may be applied to the carrier nut 56, e.g., in the direction indicated by arrow 138. The increased setting torque (e.g., increased over the torque discussed above in FIG. 7) applied to the seal assembly 44 though the carrier nut 56 causes the upper shear pin 116 to fail, e.g., shear. The collapsed shear pin 116 allows the upper seal body 114 to fall in the axial direction as indicated by arrow 142. The upper seal body 114 falls to a second position such that the upper seal body 114 engages the upper elastomeric seal 112, ramping the upper elastomeric seal 112 from the radially retracted position to a radially expanded position and sealing the upper end 110 of the seal assembly 44 against the wellhead 12. After radial expansion of the lower elastomeric seal 92 and the upper elastomeric seal 112, the seal integrity may be tested by using a first test port 144 and a second test port 146. For example, pressure may be applied between the seals 92 and 112 by applying pressure via the first test port 144 and/or the second test port 146.

Figure 9:
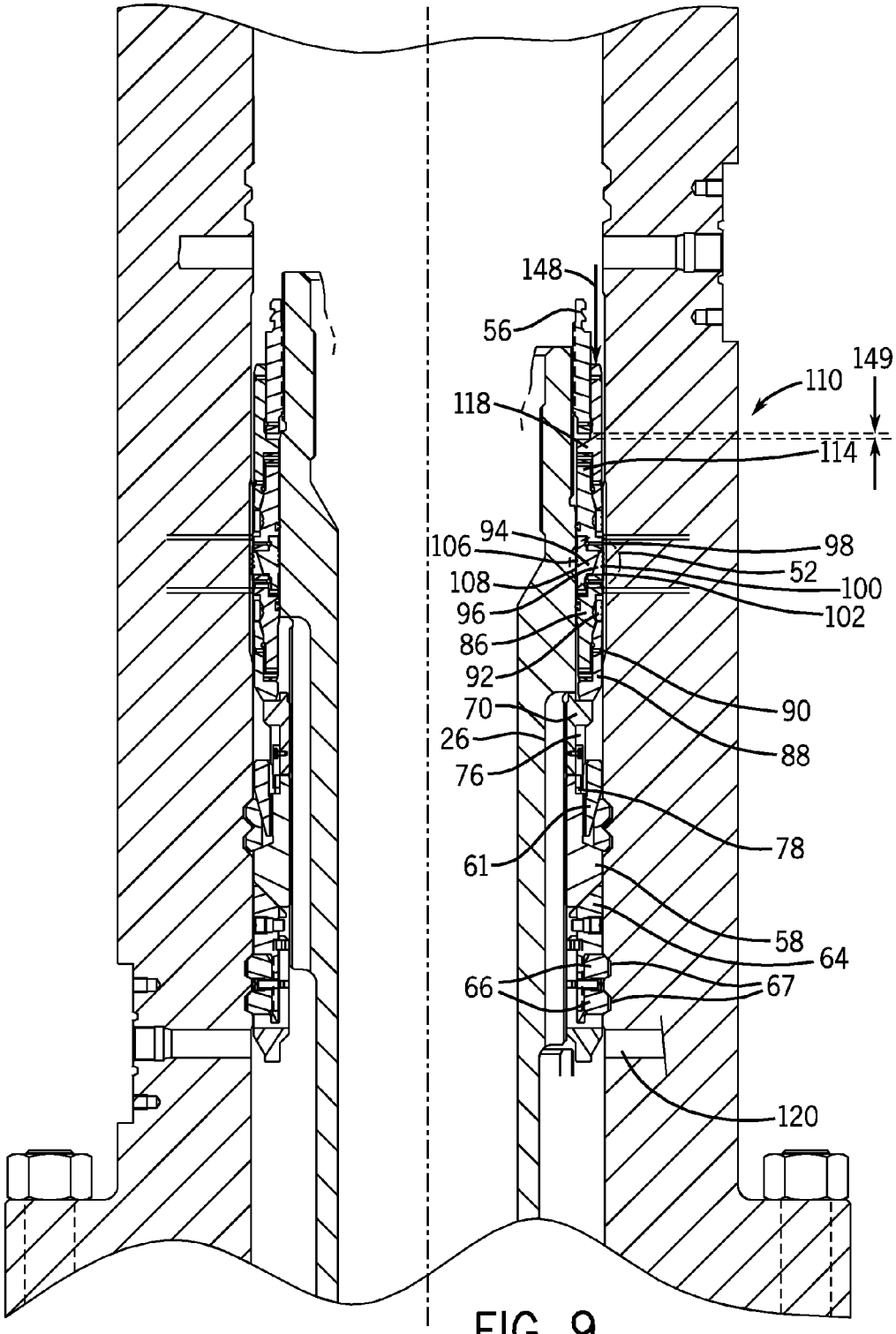
FIG. 9 depicts a cross-section of the mineral extraction system illustrating energizing an inner metal seal and an outer metal seal of a seal assembly in accordance with an embodiment of the present invention.

As mentioned above and as shown in FIG. 9, the third feature 52 includes the inner metal seal 94 having three small radius nibs 106 and one flat surface nib 108, and an outer metal seal 96 having three small radius nibs 100 and one flat surface nib 102. FIG. 9 depicts installation of the inner metal seal 94 and outer metal seal 96 in accordance with an embodiment of the present invention. The inner metal seal 94 and outer metal seal 96 may be set by collapse of the middle shear pin 98. A hydraulic tool may apply hydraulic force at the proximate end 110 of the seal assembly 44, as indicated by arrow 148. The hydraulic force 148 causes the middle shear pin 98 to fail, e.g., shear. The collapse of the shear pin allows the upper actuation ring 118 to engage the inner and outer metal seals 94 and 96, setting the position of the inner metal seal 94 and outer metal seal 96 to provide sealing against the wellhead 12 and the hanger 26. A tapered interface between the inner metal seal 94 and outer metal seal 96 causes radial expansion of the seals 94 and 96 in response to axial force. In other words, the tapered interface causes radial inward engagement of the inner metal seal 94 and radial outward movement of the outer meal seal 96 causes radial outward engagement of the outer metal seal 94. Finally, as also shown in FIG. 9, the carrier nut 56 may be further rotated, e.g., torqued down, to reduce or eliminate the gap 149 at the upper end 110 of the seal assembly 44 while the hydraulic actuation force 148 is still applied to the upper actuation ring 118. Once the gap is closed, the hydraulic actuation force 148 may be released. Thus, the carrier nut 56 takes over and transfers the setting load to the hanger 26 to keep the metal seals 94 and 96 against the hanger 26 and surface of the wellhead 12. [

Figure 10B:
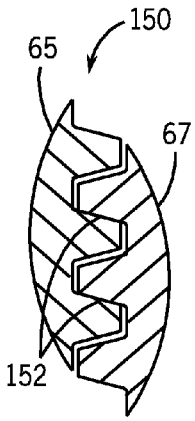
Figure 10C:
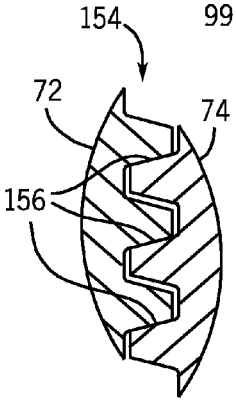
Figure 10A:
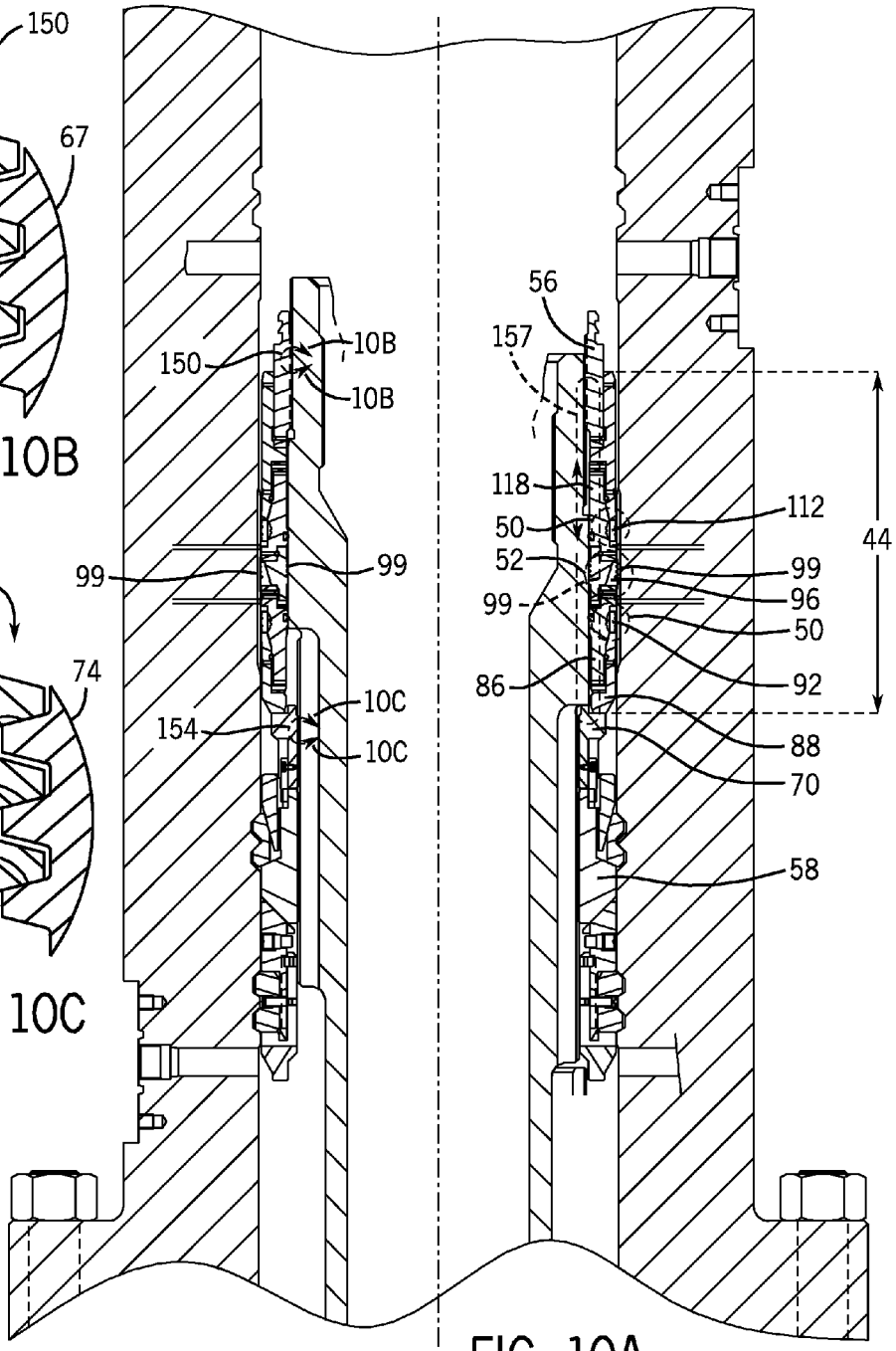

FIGS. 10A-10K depict reaction of the seal assembly 44, the floating ring 70, and adjustable landing ring 58 during operation of the wellhead 12 and hanger 26 in accordance with an embodiment of the present invention. For example, as explained further below, the floating ring 70 isolates pressure above of below the hanger 26 from the seal assembly 44 and/or the adjustable landing ring 58. Because the seal assembly 44 and adjustable landing ring 58 are isolated from these pressures, integrity of the seal assembly 44 and adjustable landing ring 58 are maintained. As shown in FIG. 10B, a close-up view of region 150, after hydraulic setting of the seal assembly 44 with the carrier nut 56 set to hold the seal assembly 44 in an energized state, the threads 65 of the carrier nut 56 contact the outer threads 67 of the hanger 26 on the top faces 152 of the threads. As shown in FIG. 10C, a close-up view of region 154, the threads 74 of the floating ring 70 contact the outer threads 72 of the hanger 26 on the bottom faces 156 of the threads 74.

After the seal assembly 44 is energized and locked down, via the carrier nut 56 and the hydraulic force as discussed in FIGS. 4-8 (and after the hydraulic force is released), the seal assembly 44 is generally blocked from de-energizing and losing sealing via axial closed loop internal movement of the components of the seal assembly 44 independent of the movement of the adjustable hanger 26. This closed loop is indicated by arrow 157 in FIG. 10A. As illustrated by arrow 157, axial movement of the upper actuation ring 118 creates an opposite axial force against the lower actuation ring 88, blocking the seal assembly 44 from de-energizing. Similarly, any axial movement of the lower actuation ring 88 creates an opposite axial force against the upper actuation ring 118, blocking the seal assembly 44 from de-energizing.

FIG. 10D depicts reaction of the seal assembly 44 during pressure exerted below the hanger 26 in accordance with an embodiment of the present invention. This pressure exerted below the hanger 26 will create an upward force on the hanger 26. The hanger 26 is restrained from moving by the lockdown ring 60 of the landing mechanism 46 being engaged in the groove 69 of the wellhead 12. The load path created by this pressure is generally indicated by arrow 158. As shown in FIG. 10D, pressure exerted below the hanger 26 passes through a lower groove 159 in the wellhead 12 and does not affect the seal assembly 44. The force created from the pressure is isolated from the seal assembly 44 as it does not pass through the floating ring 70.

The pressure exerted below the hanger 26 may cause axial upward movement of the hanger 26, as indicated by arrow 160. The carrier nut 56, floating ring 70, and adjustable landing ring 58 react to such pressure 158 in order to maintain seal integrity. For example, the carrier nut 56 experiences no change in contact position, as the carrier nut 56 moves up with the hanger 26. As shown in FIG. 10E, the threads of the carrier nut 56 remain in contact with the outer threads of the hanger 26 on the top faces of the threads. Additionally, because the carrier nut 56 moves upward with the hanger 26, the seal setting load on the seal assembly 44 is unchanged, preserving the sealing integrity of the seal assembly 44. For example, as shown in FIG. 10F, the threads 74 of the floating ring 70 remain in contact with the outer threads 72 of the hanger 26 on the bottom faces 156 of the threads 74. Finally, as shown in FIG. 10G, a close-up view of region 162, the outer threads 63 of the hanger 26 move from contacting the threads 62 at the bottom faces to the top faces 164 of the outer threads 63, transferring the upward force to the lockdown ring 60 and to the wellhead 12 (as shown by arrow 158).

Figures 10H, 10I, 10J, 10K:
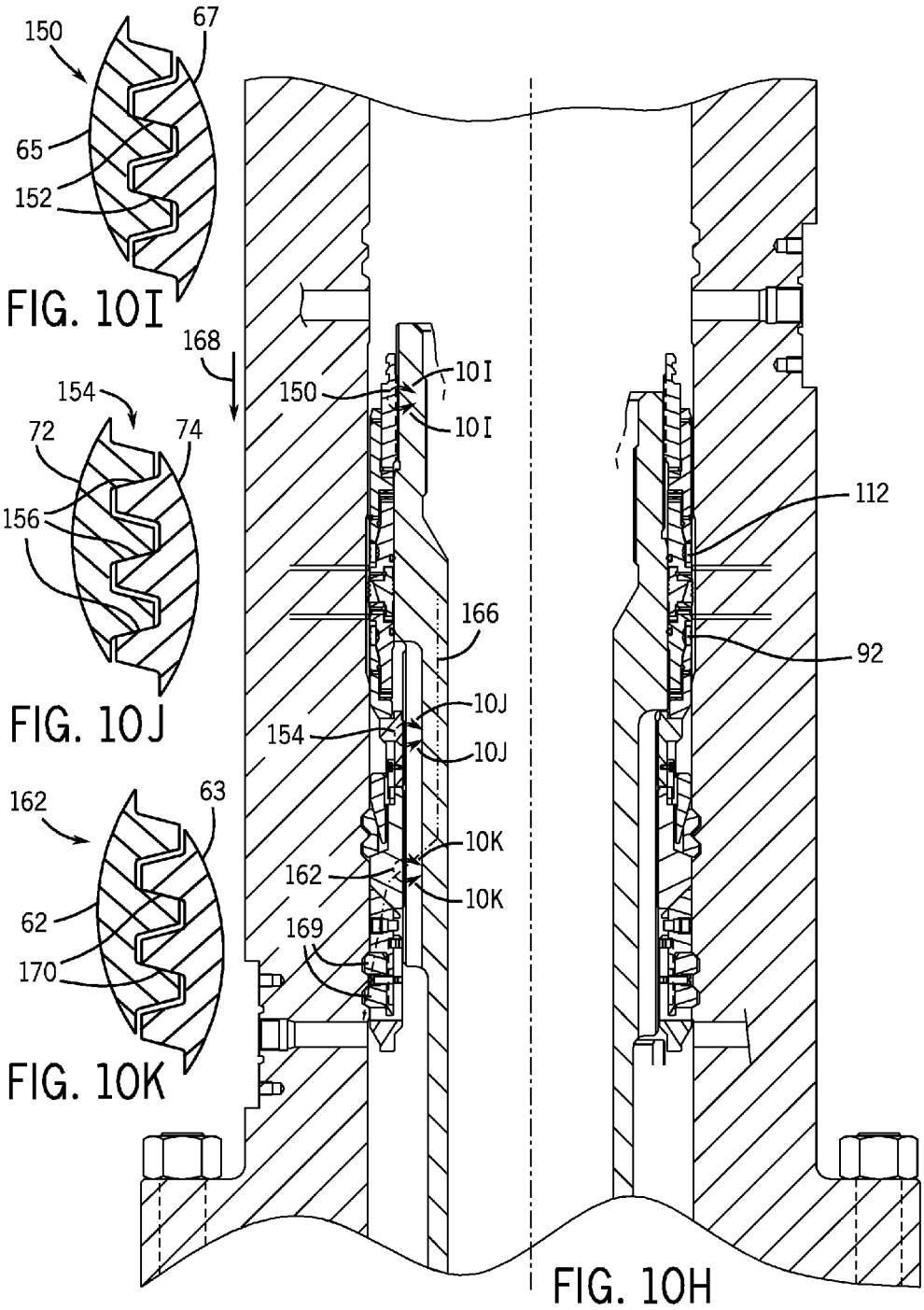

FIG. 10H depicts reaction of the seal assembly 44 during pressure exerted above the hanger 26 in accordance with an embodiment of the present invention. The pressure exerted above the hanger 26 may create a downward force on the hanger 26. The hanger 26 is restrained from moving by the lockdown ring 60 of the landing mechanism 46 being engaged in the groove 69 of the wellhead 12. The load path created by the pressure exerted above the hanger is generally indicated by the arrow 166. As shown in FIG. 10H, pressure exerted above the hanger 26 passes through a groove 169 in the wellhead 12 and does not affect the seal assembly 44. As mentioned above, the force created from the pressure is isolated from the seal assembly 44 as it does not pass through the floating ring 70.

The pressure exerted above the hanger 26 may cause axial downward movement of the hanger 26, as indicated by arrow 168. The carrier nut 56, floating ring 70, and adjustable landing ring 58 react to the pressure to maintain seal integrity. For example, the carrier nut 56 experiences no change in contact position, as the carrier nut 56 moves down with the hanger 26. As shown in FIG. 10I, the threads of the carrier nut 56 remain in contact with the outer threads of the hanger 26 on the top faces 152 of the threads. Additionally, because the carrier nut 56 moves downward with the hanger 26, the seal setting load on the seal assembly 44 is unchanged, preserving the sealing integrity of the seal assembly 44. Thus, as shown in FIG. 10J, the threads 74 of the floating ring 70 remain in contact with the outer threads 72 of the hanger 26 on the bottom faces 156 of the threads 74. Finally, as shown in FIG. 10K, the outer threads 63 of the hanger 26 move to (or remain) contacting the threads 62 at the bottom faces 170 of the outer threads 63, transferring the downward force to the lockdown ring and out to the wellhead 12 (as shown by arrow 166). Although threads 63 remain in contact with threads 62 on the faces 170, a higher load may exist on these threads 63 and 62, potentially causing deflection or bending of the threads. The maintained gap 149 may prevent any contact of the seal assembly 44 as a result of this load that may affect integrity of the seals of the seal assembly 44. In contrast, if the gap is not maintained, the increased load on the seals of the seal assembly 44 may over-energize the seals, and the seals may relax and leak when the pressure is removed.

Figure 11:
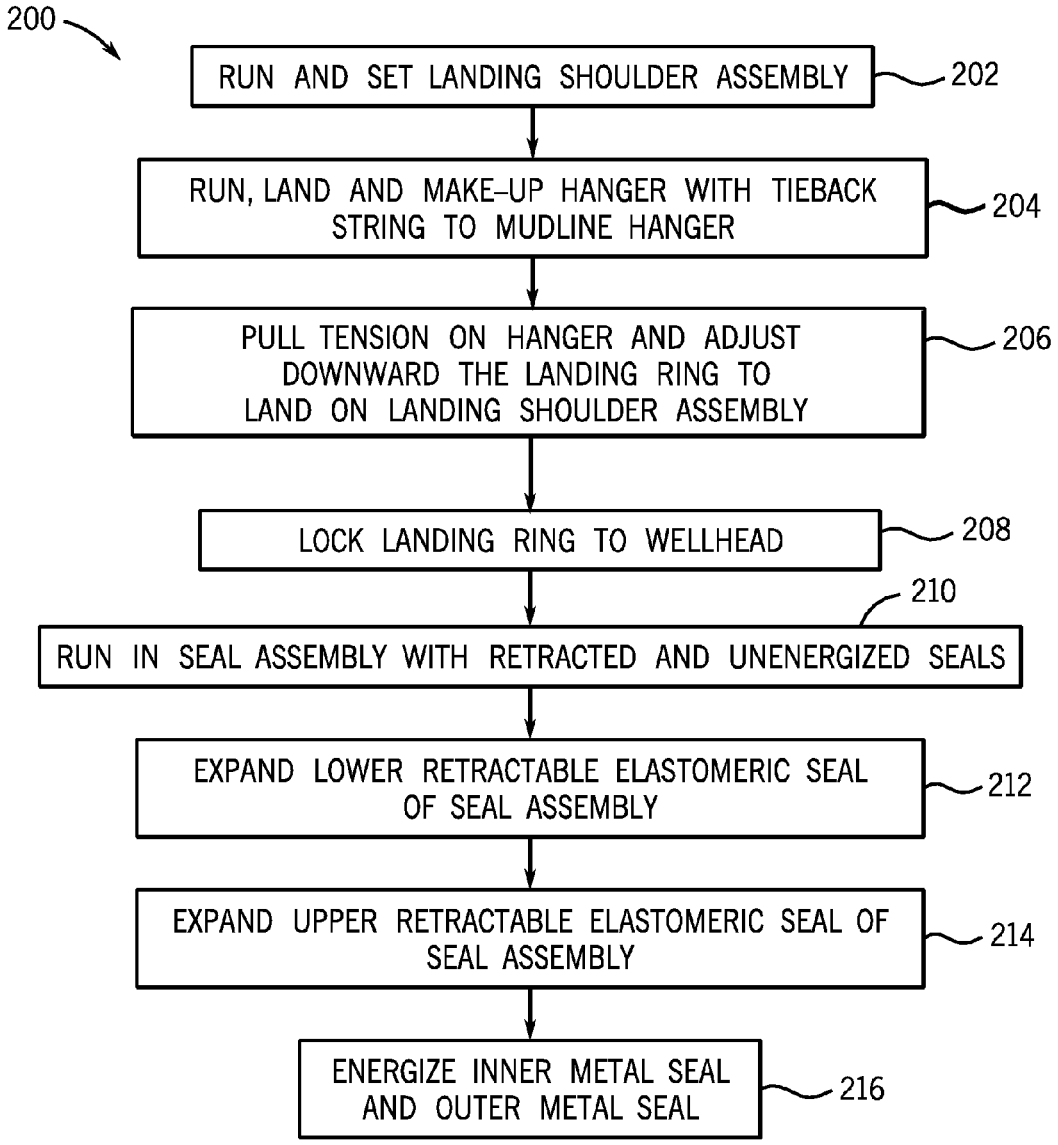
FIG. 11 is a block diagram of a process for installing the hanger and seal assembly in accordance with an embodiment of the present invention.

FIG. 11 depicts a process 200 for installing the hanger 26 and seal assembly 44 in the wellhead 12 in accordance with an embodiment of the present invention. In some embodiments, the process 200 may be an example of installation and operation of a surface system. In other embodiments, the process 200 may be a part of installation and operation of other systems, such as a subsea system. As illustrated above in FIG. 4, the landing shoulder assembly 64 may be run and set into the wellhead 12 (block 202) with a running tool (not shown). The landing shoulder assembly 64 may be set (e.g., locked to the wellhead 12) via the lockdown ring 66. As described above, the landing shoulder assembly 64 provides a landoff datum for the hanger 26.

After installation of the landing shoulder assembly 64, the hanger 26, with a tieback string below, may be run into the wellhead 12 with a hanger running tool, and the tieback string may be landed and made-up to a mudline hanger below (block 204). As shown in FIG. 5, the hanger may land relatively high or relatively low, as illustrated by the distance 58. A predetermined tension may be created in the hanger string to stretch it sufficiently. A tool enables the landing mechanism 46 to be rotated and moved axially downward to land off on the landing shoulder assembly 64 (block 206). as illustrated in FIG. 5. Further rotation of the tool may allow the landing ring 58 may be set (e.g., locked to the wellhead 12), via the lockdown ring 60 (block 208), thus locking the hanger 26 in the wellhead 12. The tension may be released, maintaining contact between the landing mechanism 46 and the landing shoulder assembly 64 and minimizing hanger movement due to wave action.

After the hanger 26 is locked down to the wellhead 12, the seal assembly 44 is run into the wellhead 12 (block 210) with the seals of the seal assembly 44 radially retracted and unenergized (e.g., the shear pins 90, 98, and 116 are in an unsheared state), as illustrated in FIG. 6. The seal assembly 44 may be landed on the floating ring 70.

To set the seal assembly 44, the radially retractable lower elastomeric seal 92 may be radially expanded by shearing the shear pin 90 (block 212), as illustrated in FIG. 7. Similarly, the radially retractable upper elastomeric seal 112 may be radially expanded by shearing the shear pin 116 (block 214), as illustrated above in FIG. 8. To complete energizing the seal assembly 44, the inner metal seal 94 and outer metal seal 96 may be energized (block 216) by shearing the middle shear pin 98, as illustrated above in FIG. 9.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A wellhead, comprising:

a hanger disposed in the wellhead;

a seal assembly disposed concentrically around the hanger;

a first ring coupled to the hanger and the wellhead and configured to allow landing of the hanger; and a second ring coupled to the hanger and axially interposed between the first ring and the seal assembly such that an axial gap is maintained between the first ring and the second ring prior to and after landing of the hanger, wherein the second ring is configured to float relative to the wellhead.

2. The wellhead of claim 1, wherein the second ring is rotationally coupled to the first ring.

3. The wellhead of claim 2, wherein the second ring is coupled to the hanger via an axial protrusion extending from the second ring into an axial recess of the first ring.

4. The wellhead of claim 1, comprising a lockdown ring coupled to the first ring and configured to lock the first ring in a first position.

5. The wellhead of claim 4, comprising an actuation ring configured to actuate the lockdown ring.

6. The wellhead of claim 1, wherein the first ring comprises threads configured to couple to outer threads of the hanger.

7. The wellhead of claim 1, wherein the second ring comprises threads configured to couple to outer threads of the hanger.

8. The wellhead of claim 1, comprising a landing shoulder disposed in the wellhead, wherein the first ring abuts the landing shoulder.

9. The wellhead of 1, wherein the seal assembly is configured to seal a portion of the hanger.

10. The wellhead of claim 1, comprising a nut disposed at an end of the hanger, such that rotation of the nut applies torque to the seal assembly.

11. The system of claim 1, wherein the first and second rings are configured to rotate in sync with one another while the second ring does not allow axial load transfer between the second ring and the first ring.

12. The system of claim 1, comprising a coupling disposed between the first and second rings, wherein the coupling comprises one or more axial protrusions disposed in one or more axial slots.

13. A wellhead, comprising:

a hanger disposed in the wellhead; and a seal assembly disposed in the wellhead concentrically around the hanger and configured to seal a portion of the hanger, the seal assembly comprising:

a first elastomeric seal moveable, after shearing a first shear structure, between a radially retracted position and a radially expanded position, wherein the first elastomeric seal is in the radially retracted position when the seal assembly is moved axially into the wellhead.

14. The wellhead of claim 13, comprising a first seal member moveable, after shearing the first shear structure, axially between a first axial position and a second axial position, wherein the axial movement between the first axial position and the second axial position moves the first seal radially from the radially retracted position to the radially expanded position.

15. The wellhead of claim 14, wherein the first shear structure is in contact with the first seal member, such that the first shear structure maintains the first seal member in the first axial position and allows the first seal member to move to the second axial position when sheared.

16. The wellhead of claim 13, comprising a second elastomeric seal moveable between a second radially retracted position and a second radially expanded position, wherein the second elastomeric seal is in the second radially retracted position when the seal assembly is moved axially into the wellhead.

17. The wellhead of claim 16, comprising a second seal member moveable between a first axial position and a second axial position, wherein the axial movement between the first axial position and the second axial position moves the second elastomeric seal from the second radially retracted position to the second radially expanded position.

18. The wellhead of claim 17, comprising a second shear structure in contact with the second seal member, such that the second shear structure maintains the second seal member in the first axial position and allows the second seal member to move to the second axial position when sheared.

19. The system of claim 13, wherein the seal assembly comprises a first annular seal body having a first tapered surface and a first seal actuating ring having a second tapered surface, wherein the first annular seal body and the first seal actuating ring are configured to engage one another along the first and second tapered surfaces to bias the first elastomeric seal from the radially retracted position to the radially expanded position.

20. A wellhead, comprising:

a hanger disposed in the wellhead; and a seal assembly disposed in the wellhead concentrically around the hanger and configured to seal a portion of the hanger, the seal assembly comprising:

a first metal seal comprising a first plurality of rings disposed on a first seal body of the first metal seal, wherein the first plurality of rings comprises a first set of first nibs and a second nib, wherein the first set of first nibs are smaller than the second nib, wherein the second nib comprises a first flat surface configured to bear an energizing load for the seal assembly and the first nibs are configured to seal the seal assembly.

21. The wellhead of claim 20, wherein the first metal seal is oriented such that the first set of first nibs and the second nib contact the outer wall of the hanger.

22. The wellhead of claim 20, comprising a second metal seal comprising a second plurality of rings disposed on a second seal body of the second metal seal, wherein the second plurality of rings comprises a second set of third nibs and a fourth nib, wherein the second set of third nibs are smaller than the fourth nib, wherein the fourth nib comprises a second flat surface configured to bear an energizing load for the seal assembly and the third nibs are configured to seal the seal assembly.

23. The wellhead of claim 22, wherein the second metal seal is oriented such that the second set of third nibs and the fourth nib contact the inner wall of the wellhead.

24. The wellhead of claim 20, wherein the first metal seal comprises a first tapered surface along the first seal body.

25. The wellhead of claim 24, comprising a second metal seal having a second tapered surface along a second seal body of the second metal seal, wherein the first and second metal seals are configured to engage one another along the first and second tapered surfaces to bias the first and second metal seals radially away from one another.

26. A wellhead, comprising:

a wellhead;

a hanger disposed in the wellhead; and a seal assembly disposed in the wellhead concentrically around the hanger and configured to seal a portion of the hanger, the seal assembly comprising:

a first elastomeric seal moveable between a first radially retracted position and a first radially expanded position, wherein the first elastomeric seal is in the first radially retracted position when the seal assembly is moved axially into the wellhead; and a second elastomeric seal moveable between a second radially retracted position and a second radially expanded position, wherein the second elastomeric seal is in the second radially retracted position when the seal assembly is moved axially into the wellhead.

27. A system, comprising:

a landing ring having first threads configured to couple with mating first threads of a hanger, wherein the landing ring is configured to couple to a wellhead to facilitate landing of the hanger; and a floating ring having second threads configured to couple with mating second threads of the hanger, wherein the landing ring and the floating ring are coupled to one another with a coupling having one or more axial protrusions disposed in one or more axial slots, an axial gap is maintained between the landing ring and the floating ring, and the floating ring is configured to be axially interposed between the landing ring and a seal assembly.

28. The system of claim 27, comprising the hanger coupled to the landing ring and the seal assembly.

29. The system of claim 28, comprising the seal assembly.

30. The system of claim 29, comprising the wellhead.

* * * * *